US005678620A

United States Patent [19]

Mayled

[11] Patent Number: 5,678,620

[45] Date of Patent: Oct. 21, 1997

[54] ANTI PICKPOCKET POUCH

[76] Inventor: Edward C. Mayled, 28 Groveland Crescent, Brampton, Ontario, Canada, L6S 1L2

[21] Appl. No.: 567,987

[22] Filed: Dec. 11, 1995

[51] Int. Cl.[6] ..... A45C 1/06; A45C 13/18

[52] U.S. Cl. ..... 150/134; 150/102

[58] Field of Search ..... 150/132–134, 150/101, 102

[56] References Cited

U.S. PATENT DOCUMENTS

| | | | |
|---|---|---|---|
| 1,380,778 | 6/1921 | Cucinotta | 150/134 |
| 2,126,826 | 8/1938 | Shively | 150/134 X |
| 2,609,855 | 9/1952 | Rothschild | 150/134 |
| 2,689,957 | 9/1954 | Fulton | 150/134 X |

FOREIGN PATENT DOCUMENTS

| | | | |
|---|---|---|---|
| 512198 | 1/1954 | Belgium | 150/132 |
| 563473 | 12/1923 | France | 150/134 |
| 2373988 | 8/1978 | France | 150/134 |

*Primary Examiner*—Sue A. Weaver
*Attorney, Agent, or Firm*—Edward H. Oldham

[57] ABSTRACT

A pouch useful for storage of valuables usually carried by a traveller. The pouch is designed for insertion into a suitable pocket of the traveller and an extending flap of said pouch overlaps the folded pouch and folds down over the exterior surface of the pocket to be secured to the surface by a button.

5 Claims, 2 Drawing Sheets

ANTI PICKPOCKET POUCH

This invention relates to a device which is designed to be used by persons travelling through areas where the art of pocket picking is likely to be practised. The device itself is a fabric pouch which comprises at least two pouches which may be folded together to yield a compact unit which may be easily inserted into a pocket in its folded condition. A protruding flap from the unit is folded over the pocket edge and is buttoned to a button which is located on the exterior surface of the material forming the pocket just below the top edge of the pocket.

BACKGROUND OF THE INVENTION

The art of pocket picking is practised in many parts of the world today. Because a traveller must carry cash money, travellers cheques, passports and other valuables and documents which are extremely valuable to persons domiciled in foreign countries, the ancient art of pocket picking is practised widely today, and in some countries, the art is so freely honed that a traveller and his valuables may be separated without any awareness on the part of the traveller until those artists have accomplished their goal and are long gone from the scene.

Most pickpockets work in teams of two or three and the valuables which are sought are removed by jostling the traveller in a sudden and unexpected manner which allows the pocket picker a window of opportunity for removal of the mark's wallet, etc. This time is very brief, (probably in the order of one or two seconds) when the traveller is vulnerable to having his pockets picked. Many prior art devices have been developed to frustrate the pocket picking artists which although clever and unyielding to the pocket picking artists, nevertheless, cause such inconvenience to the traveller when access to documents carried in such prior art devices is necessary the traveller must partially undress or perform body contortions that would be best practised by an escape artist in an effort to wrestle valuable documents from a "safe and secure" depository on the body. While such body contortions are amusing to fellow travellers, the embarrassment caused to the person trying to produce proper documentation at an immigration control point before the immigration authority and fellow travellers cannot be overstressed.

Probably the "safest" device to be developed up to the present time is the money belt and the money belt does provide a good level of security, but the device tends to be inconvenient and awkward to use. Skilled pickpockets are aware that their "window of opportunity" is very short and does not yield sufficient opportunity to separate a traveller from valuables secured in a money belt. This is the reason why the money belt has won wide acceptance in spite of its shortcomings.

Money belts are really intended for carrying cash and travellers cheques beneath the clothing of the wearer and are generally not really very convenient for carrying credit cards and other documents of identification, such as passports, visas, etc. which are usually carried in a place where retrieval is convenient.

Because of the shortcomings of the moneybelt, the wearer tends to carry only cash and travellers cheques, etc. in the moneybelt, with passports, visas, etc. being carded in some other location on the body, whilst credit cards, driver's licence and valuable memorabilia are carried in a wallet where they may be instantly produced.

While this method of carrying of valuables certainly provides ample protection for the cash and travellers cheques, the wallet is susceptible to pickpockets so that a traveller may ultimately be stranded in a foreign country with ample cash, to say, rent a motor vehicle and have no driver's licence because a pickpocket had previously stolen his wallet in which the licence was stored.

It is therefore an object of this invention to provide the traveller with a pouch which will carry the traveller's cash, identification, credit cards, and other valuables in a location on the travellers person which renders the valuables conveniently available for production when requested by legitimate enforcement officers, but otherwise requires such manual dexterity on the part of the pocket picking artist that the "window of opportunity" will be passed before removal of the pouch may be accomplished.

PRIOR ART

U.S. Patents:

U.S. Pat. No. 2,859,449—Nov. 11, 1958

U.S. Pat. No. 4,553,269—Nov. 19, 1985

U.S. Pat. No. 4,852,188—Aug. 1, 1989

U.S. Pat. No. 5,082,157—Jul. 21, 1992

U.S. Pat. No. 5,121,864—Jul. 16, 1992

SUMMARY OF THE INVENTION

This invention is a pouch which is foldable and has two or more compartments which are preferably separated so that valuables need not be secured in a single compartment. The pouch has a pair of flaps which extend from both ends of the pouch in its unfolded position. When folded, one of the flaps is inserted in the pouch opening of the opposing side pocket. The remaining flap (enclosing) from the second pouch side is now folded over both pocket openings (and the folded first flap) and buttoned down. In most cases the folded pouch is designed to neatly fit into an inside jacket pocket and after the pouch has been inserted into the jacket pocket, the second or enclosing flap extends completely over the folded pouch and is buttoned down on at least one button sewn on the interior lining of the jacket just below the pocket opening. It is this feature that provides the obstacle to quick and easy removal of the pouch by the pocket picking artist.

It is the object of this invention to provide a security pouch having more than one compartment which may be inserted and fastened into any pocket, but preferably an interior pocket of a jacket worn by the owner of the pouch.

This invention also will provide a secure pouch which may be inserted inside a trouser or skirt waistband in its folded condition so that the presence of the pouch is concealed, and the overlapping flap is then folded over the waistband or belt if one is worn, and buttoned down so as to become a part of the garment.

Because of the button attachment, this pouch will remain in the jacket pocket even if the jacket is removed to be placed, in say, the overhead storage compartment of an aircraft during an airline flight, as often happens in aircraft travel. The pouch in effect becomes a part of the garment to which it is attached.

DESCRIPTION OF PREFERRED EMBODIMENT

Figure 1:
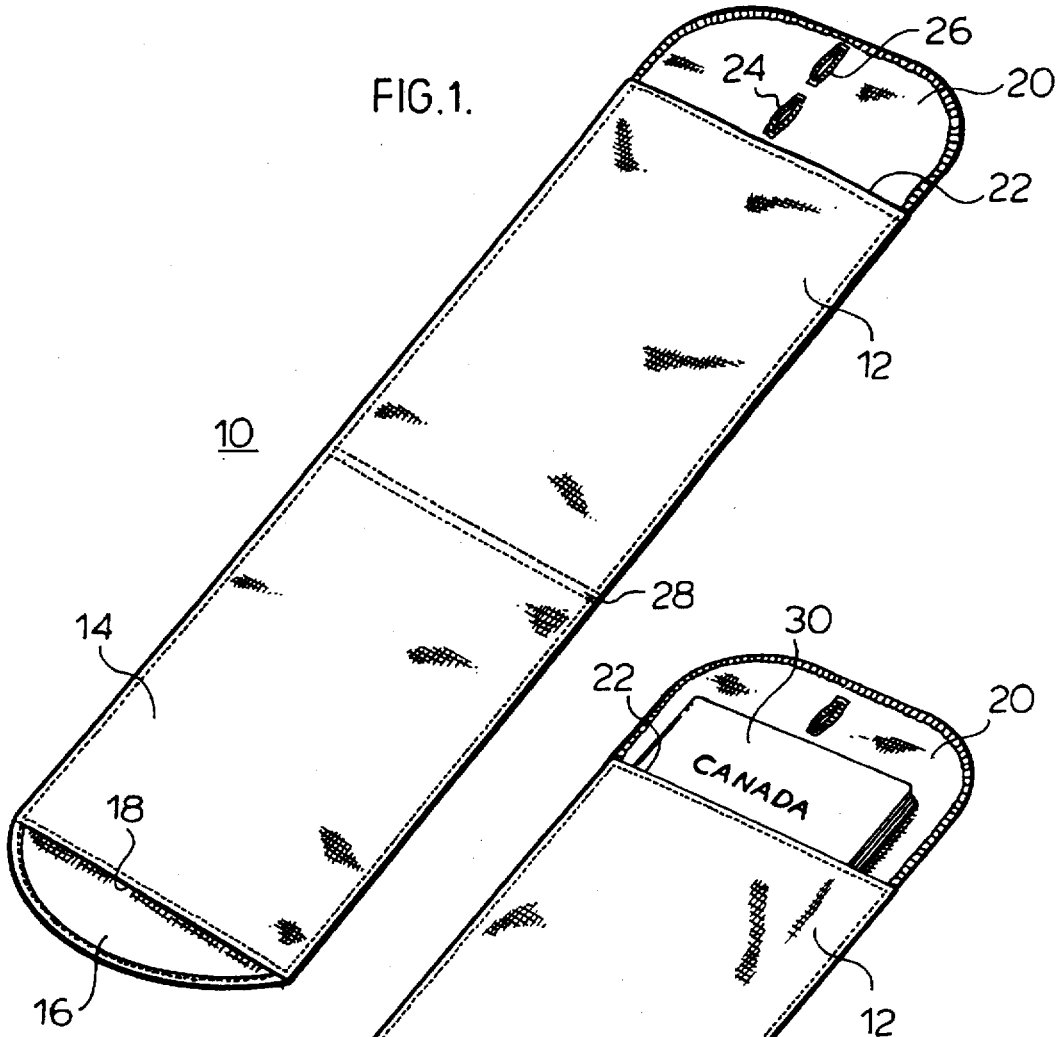
FIG. 1 shows a perspective view of the open pouch of this invention.

Referring now to the drawings and FIG. 1 in particular, the pouch 10 of this device is shown having two compartments or pockets 12 and 14. The pockets are of such size as to fit into the interior pocket of a suit jacket, etc. when each pocket is carrying the valuables generally associated with travel, i.e. passport, credit cards, cash and travellers cheques.

A flap 16 extends past opening 18 in pocket 14 and a second flap 20 extends from the remote end of pouch 10 past opening 22 and is of substantially greater length than flap 16. Flap 20 is provided with two button holes 24 and 26 located therein.

Pouch 10 has a mid seam 28 which provides the bottom of each of pockets 12 and 14.

Pouch 10 may be made of any fabric which is strong and capable of being folded at 28. Flaps 16 and 20 must be amenable to folding as well. In some instances, it is desirable to have water resistant material such as GORTEX® which will allow any accumulated moisture in the pockets to pass through the pocket in vapor form, but prevent the ingress of water through the material.

Figure 2:
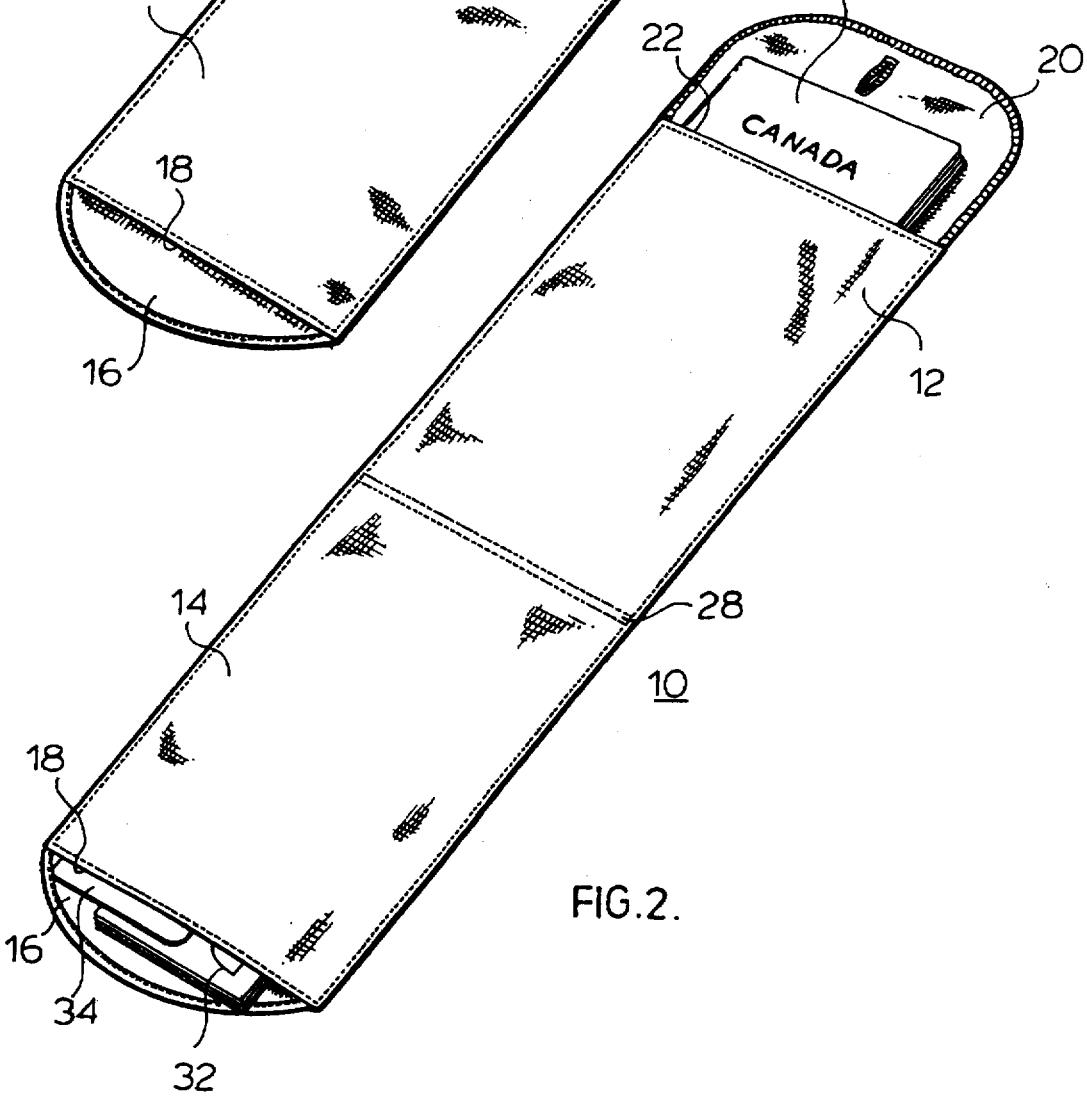
FIG. 2 shows the pouch partially filled.
Figure 3:
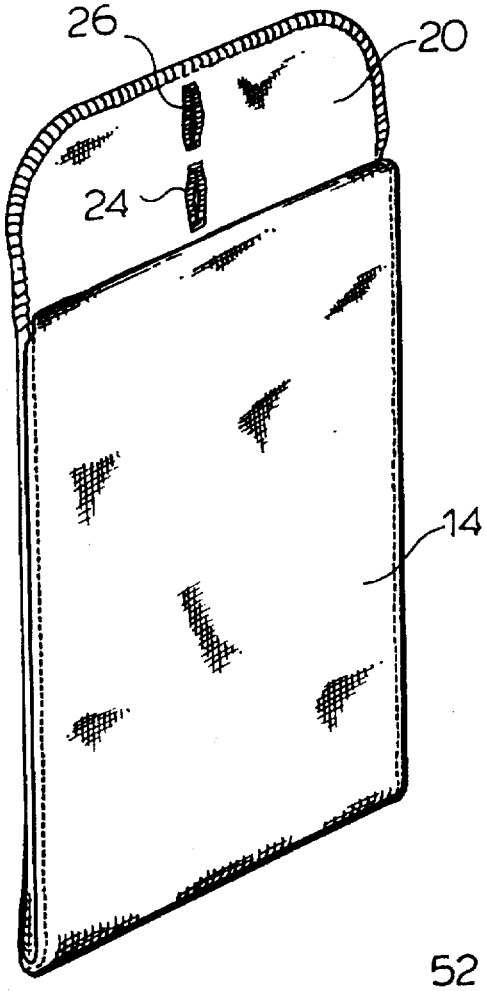
FIG. 3 shows the pouch in a folded condition.

FIG. 2 shows the pouch 10 being filled with travel documents and other materials generally carried by a traveller. A standard passport 30 is received quite easily in pocket 12 while cash 32 and credit cards 34 are received in pocket 14. The various articles are pushed completely into pockets 12 and 14 and the pouch is folded as shown in FIG. 3.

Flap 16 is inserted in pocket 12 to secure the pouch in the folded position.

Figure 4:
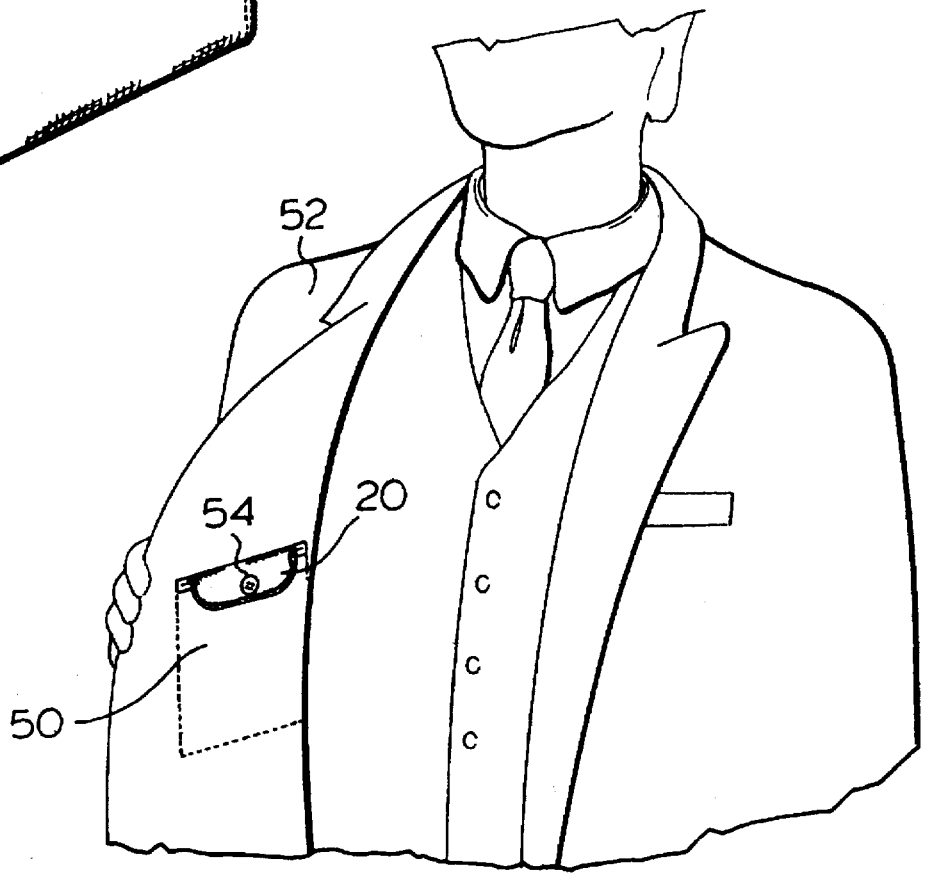
FIG. 4 shows the pouch installed in a jacket pocket.

The pouch is now in a suitable condition to be inserted into an interior suit jacket pocket such as the pocket 50 of jacket 52 as shown in FIG. 4. The pouch is inserted in pocket 50 with flap 16 still held in pocket 12. When pouch 10 is inserted in pocket 50, flap 20 is folded over the already folded pouch so that flap 20 passes over the fold of flap 16 and is buttoned to the jacket by means of button 54. In this manner, the pouch essentially becomes a part of jacket 52. In some instances, two buttons such as 54 may be provided in spaced relationship located the same distance below the pocket edge.

The pouch is now secured in the jacket pocket 50 so that a pocket picking artist must undo flap 20 from button 54 before removal of the pouch may be accomplished. This makes the pouch removal sufficiently difficult that even most preoccupied pouch bearer would become aware of the nefarious act that was intended to separate the pouch bearer from his valuables.

The pouch 10 may be conveniently inserted inside the waistband of a skirt or trousers in a manner similar to insertion into pocket 50, and of course a button such as button 54 must be provided to prevent easy dislodgment of the pouch from the waistband location.

Preferably the flap 20 may be colored to match the fabric to which it is buttoned to camouflage the pouch even further.

The pouch 10 may be altered without departing from the spirit of this invention. For instance, pockets 12 and 14 may be closed at the remote ends of the pouch and have openings at the center seam of the pouch.

In a similar manner, flap 16 may be fastened to remote end of the pouch in a folded condition by use of a VELCRO® fastener. Similarly, the flap 20 may be secured to the exterior surface of the pocket 50 by means of a VELCRO® fastener instead of button 54. Zippers may be used to close the compartments 12 and 14.

While other departures are possible, applicant prefers to limit the ambit of protection of this invention by the ambit of the following claims.

We claim:

1. An elongated foldable security pouch being of such length and width so as to conveniently fit into the inside pocket of a jacket of a wearer when folded comprising:

a substantially flat receptacle having two compartments formed therein for carrying valuables therein, each compartment communicating with an opening at the end of said pouch, said pouch being foldable so that the opposing ends of said pouch meet in registry in the folded condition, each of said ends having a flap of a width corresponding to the width of said pouch extending therefrom, the flap extending from a first of said ends entering the opening in the opposing end of the folded pouch, the flap extending from a second end of said pouch being folded over both ends of the folded pouch and the edge of the pocket of said wearer when said pouch is secured in the pocket of said wearer, said second flap having a fastening means therein for fastening to said jacket.

2. A security pouch as claimed in claim 1 wherein said fastening means comprises a buttonhole, and said pocket has a button mounted on the exterior surface of the pocket of said wearer for engagement by said fastening means.

3. A security pouch as claimed in claim 2 wherein the pouch is composed of a suitable fabric sewn together to form said compartments, said pouch having a seam extending across the pouch substantially midway between the ends thereof.

4. A security pouch as claimed in claim 1 wherein said fastening means is a button hole and a button.

5. A security pouch as claimed in claim 1 wherein said fastening means is a multiple hook and loop fastener.

* * * * *